United States Patent [19]

Wislocker et al.

[11] Patent Number: 4,881,584

[45] Date of Patent: Nov. 21, 1989

[54] INFEED CONVEYOR FOR SAW

[75] Inventors: Frank Wislocker, Sumner; Charles Blickenderfer, Puyallup, both of Wash.

[73] Assignee: Weyerhaeuser Company, Tacoma, Wash.

[21] Appl. No.: 294,233

[22] Filed: Jan. 9, 1989

[51] Int. Cl.[4] ..... B27C 9/00; B27C 1/08

[52] U.S. Cl. ..... 144/39; 83/423; 83/435.1; 144/3 R; 144/242 A; 144/242 D; 144/245 A; 144/369; 144/378; 144/246 E; 198/631; 198/841

[58] Field of Search ..... 144/3 R, 39, 41, 242 R, 144/242 D, 242 C, 242 E, 245 R, 245 A, 246 E, 249 A, 369, 356, 357, 376, 377, 378; 83/435.1, 423, 422; 198/631, 841

[56] References Cited

U.S. PATENT DOCUMENTS 3,934,630 1/1976 Cockle ..... 144/39

*Primary Examiner*—W. Donald Bray

[57] ABSTRACT

The invention is an infeed conveyor for a saw which enables feeding sweepy cants or logs in such a manner as to achieve a significant improvement in lumber recovery. The conveyor has at least one portion which can be configured between a straight line track and a curve which approximates an arc of a circle. The arc can be adjusted so that it approximates the sweep curvature of the log or cant which can then be guided into a saw along a path approximating it radius of curvature. The conveyor consists of a sharp chain having at least one portion running on a slide bar which can be configured to give the desired curvature. The conveyor can further be adjusted with regard to the following saw or saws to control offset. In its most preferred version a pair of chipper heads is located between the conveyor and saws to dress the upper and lower faces of an incoming cant into a gang cant of predetermined depth.

15 Claims, 4 Drawing Sheets

INFEED CONVEYOR FOR SAW

BACKGROUND OF THE INVENTION

The present invention is an infeed conveyor for a saw that can optimally feed cants or logs having varying amounts of sweep from piece to piece. The invention further includes the combination of the conveyor with a circular saw or saws. This permits logs to be sawn around the curve of their sweep to obtain maximum lumber recovery.

Within a few more years, the last of the old growth timber available for harvesting in the United States will have been cut. Most of the sawmills which formerly depended on large old growth logs have already had to convert the equipment in their mills to that which is suitable for handling much smaller logs at high throughput volumes. One common characteristic of second growth timber is that the logs usually have varying but larger amounts of sweep or curvature. The presence of sweep results in yields which are significantly lower than those which are attainable from straight logs. This is because much of the curved portion must be machined off in order to produce cants or lumber having the usual configuration of a rectangular parallelepiped.

Many small log sawmills orient the log prior the primary breakdown saw so that the greatest curvature is either up or down (horns up or horns down) rather than side to side. These openings cuts may be made either by saws, which remove side boards and slabs, or by chippers which reduce the slabs to wood chips suitable for pulping. The result is a cant having parallel faces on two sides. As noted earlier, cants sawn in this fashion tend to have appreciable sweep. Sweep is here defined to mean the curvature on the concave edge of the cant when the cant is placed on one of its flat faces. While occasional instances of extreme sweep occur, in most cases sweep is rarely larger than about 100 mm in a cant approximately 5 m long (about 4 in. in 16 ft.). Most typically, it will average between 25 and 50 mm in 5 meters.

Man has ad to attempt to cope with geometric irregularities in logs ever since he began to utilize trees. Thus, it is not unexpected that the prior art shows previous attempts to deal with sweepy cants and to devise schemes for improving the yield from cants of this type.

As general background to the present invention, reference can be made to U.S. Pat. Nos. 259,661 to Bowker and 1,263,443 to Lien. Both of these inventors devised schemes for sawing wooden barrel hoops along a path that was precisely parallel to the outside surface of the log. This was deemed necessary in order to reduce the presence of cross grain which would reduce the strength of the hoop. Somewhat more pertinent is Great Britain Pat. No. 545 of 1852. In this sawing device, a tree was placed on a carriage which could be moved in a circular arc with respect to a saw. The purpose here appears to be to cut complex curved and/or angled ships timbers. However, it appears inherent in the invention that cuts could be made parallel to the surface of a curved log.

Japanese Patent No. 49-7557 shows a device used for "sawing around the curve" of a cant which contains sweep. The cant is first sawn to produce one good edge parallel to the original surface. After this point, additional boards can be taken off parallel to this surface by manually steering the cant as it emerges from the saw.

Swedish Patent No. 33,098 is a sawing device having feed rolls which can be canted so that the axes lie at an angle and intersect at a point corresponding to the arc of a curve along which a cut is to be made. U.S. Pat. No. 3,685,556 to VanSickle takes a somewhat different approach. This inventor shows a device for use with a shop band saw for cutting predetermined contoured pieces from straight stock to make; e.g., Christmas tree stands. More conventional approaches are described in U.S. Pat. Nos. 3,665,984 to Ackerfeldt, 4,416,312 to Ostberg and Swedish Patent No. 306,415. These, in general, deal with positioners for optimizing yields from curved cants by straight line sawing. The patnt to Ackerfeldt is valuable for the background it gives to this type of approach.

While it has been noted that increased yields can be obtained by "sawing around the curve," until very recently nothing has been done to make this a practical approach in a modern, high-speed sawmill. The closest examples can be found in U.S. Pat. Nos. 4,144,782 and 4,219,056 to Lindstrom and U.S. Pat. No. 4,373,563 to Kenyon. The earlier of the two Lindstrom patents is of particular interest. In the device described, a log is fed into what is preferably a single band saw along a path which follows the curvature of the log. The log lies on a roll case with two pairs of opposing vertical guide rollers upstream from the saw. These guide rollers embrace the cant as it is fed into the saw. They are mounted on frames transversely displaceable to the path of the log so that the log is directed along a curve to which the saw blade is tangent. Lindstrom further notes that the bowed boards resulting from around-the-curve sawing will generally flatten out when they are kiln dried. Kenyon have had limited commercial application although However, the cant is oriented by lateral pressure applied only ton ne side of the cant by a roller located upstram from the point of sawing.

To the present inventors' knowledge, the devices taught by Lindstrom and Kenyon have had limited commercial application although their use has not become widespread. This may possibly be because they are of limited use in a high-speed sawmill which may typically run 10–20 cants per minute through a gangsaw.

Practical means for sawing logs around their sweep curvature at the high speeds necessary in modern sawmills has recently been disclosed in the following patents: Hasenwinkle et al, U.S. Pat. No. 4,633,924; Wislocker et al, U.S. Pat. No. 4,653,560; and Hasenwinkle, U.S. Pat. No. 4,690,188. The first of these patents shows a line bar which can be bent to conform to the sweep curvature of an individual log or cant. This line bar is set up along the edge of a roll case or similar conveyor to guide the piece being sawed into a vertical gang saw. The second patent is similar, but here the line bar is of fixed curvature which approximates the average sweep curvature of the cants being sawn. While the first of these methods will give somewhat higher lumber recovery, it is not particularly efficient in the use of available space. For sawing logs that have considerable sweep, the infeed end of the line bar must often by deflected as much as 60 cm, or even more. Frequently there is not adequate room for deflection of this magnitude in a sawmill, particularly when the line bar is used to retrofit an existing saw. The apparatus described in U.S. Pat. No. 4,690,188 was then developed to overcome this difficulty. Here the line bar is bent to a configuration equivalent to the radius of curvature of the incoming cant. However, in this case the saws are also skewed somewhat, depending on the amount of line bar curvature. Using this method, line bar deflections of as little as 20 cm can accommodate even those cants having considerable sweep. This latter system can be used with either vertical or horizontal arbor gang saws. However, no wholly satisfactory log infeed system had been developed at the time of this patent for use with a vertical arbor saw. It was a requirement that the lower portion of the cant slide along the line bar and feeding had to be accomplished either by using a series of opposed drive rolls acting against each side of the cant or by using a series of single driven rolls working against the top of the cant. In either case, the inherent inaccuracy in the feeding system frequently resulted in lumber with poor dimensional accuracy. The present invention has overcome these problems and contributed many other desirable features which improve accuracy and yield in a high speed, small log sawmill.

SUMMARY OF THE INVENTION

The present invention is an infeed conveyor for a saw, such as a circular gang saw, for feeding cants or logs having varying amounts of sweep from piece to piece. Infeed to the saw is accomplished so that yield and lumber quality are maximized. The invention further comprises a combination of the above conveyor with a saw. Optionally, one or more chipper heads may be located between th conveyor and saws to recover wood chips from the unmachined top and bottom surfaces of the log or cant. The term 'cant' will be used hereafter to include either a raw log or a log which has had preliminary machining to produce one or more flat faces.

The conveyor has as a first element an endless sharp chain for conveying the cants. By a sharp chain is meant a sprocket driven chain having upstanding spikes or similar protrusions for engaging a cant and holding it in a fixed position relative to the chain. A drive system is then provided for the chain. This includes a tail sprocket at the cant receiving end and a head sprocket at the cant discharging end of the sharp chain. The sharp chain has an upper cant transporting run and a lower return run. A flexible slide bar supports at least that portion of the upper run of the chain which includes the cant discharging end. The sprockets and slide bar are appropriately mounted in a first frame. The slide bar is coupled to a bending mechanism which can conform it between a straight line and a curve which approximates an arc of a circle. The sharp chain closely follows the particular confirmation of the slide bar. In this manner a cant can be guided into the saw along a path which approximates its radius of sweep curvature.

In a preferred construction of the invention the flexible slide bar will generally underlie about half of the upper run of the sharp chain. While its length may be varied, the flexible slide bar should be at least as long as the longest cant that will be processede. An additional fixed straight line slide bar provides support for that portion of the upper run that includes the cant receiving end.

The slide bar can be bent into its preferred curved configuration by a number of mechanisms, including those showni n U.S. Pat. Nos. 4,633,924 and 4,690,188. A preferred bending mechanism includes a longitudinal push or control rod located beneath the slide bar and connected to it with a first series of actuating linkages. These are of varying lengths and are pivotally connected between the push rod and the slide bar. As the push rod is moved, the linkages act to control the slide bar curvature in response to the push rod position. The push rod may be retained within conventional linear bearings attached in fixed position on the first frame. It can also be stabilized using a second series of linkages, all of essentially identical length, pivotally connected between the push rod and the frame, preferably located immediately below the first series of linkages. Push rod position can be conventionally controlled by any of the well known means such as a rack and pinion drive or a fluid actuated cylinder.

In one preferred version of the invention the conveyor is adjustable for offset. By offset is meant the distance between the top of the conveyor, or the bottom o the cant, and the first or "zero" saw. Alternatively, if a lowe chipper head is located between the conveyor and saw, offset would be adjusted between the conveyor and chipper head. This is conveniently accomplished by providing a seconf fixed position frame in which the first frame holding the conveyor assembly is pivotally mounted. A preferred pivot point is the axis of rotation of the tail sprocket at the log receiving end. Appropriat adjustment is made by a method which could employa screw or second fluid cylinder acting between the first and second frames to raise or lower the discharge end of the conveyor. Alternatively, each end of the conveyor could be simultaneously raised or lowerd. In the first method the conveyor is moved arcuatelyr elative to a base line, while in the second method it is moved parallel to the base line. Since the amount of offset adjustment needed at the discharge end is normally quite small; i.e., less than 5 cm, the former method is preferred due to its greater simplicity of construction.

The saw or saw system used with the conveyor can be any conventional vertical arbor single circular saw or gang saw. Most preferably the saw assembly is mounted within a pivotable subframe or fourth frame mounted on a fixed position third frame. The saw or saws are mounted in the fourth frame so that they can be tilted or skewed in similar fashion to the manner taught in U.S. Pat. No. 4,690,188. The skewing means may consist of a screw or fluid cylinder operating between the third and fourth frames. In this manner the saws can be tilted so that the projected continuation of the discharge portion curvature of the conveyor is essentially tangent to a plane parallel to the plane of the saw at a point on the projection of the axis of the saw arbor. In this way the entry angle of the log or cant into the saw is controlled so as to prevent binding.

The new conveyor and saw configuration permits installation of one or more chipper heads between the conveyor discharge point and saw entry point. A lower chipper head can be placed below the incoming log to dress its lower surface prior to sawing. Similarly, a second chipper head can be located above the incoming log to dress the upper surface thereof prior to sawing. In a preferable configuration, the lower chipper head will have a transverse axis which acts as the pivot point for the fourth frame means and for skewing the saws.

It is an object of the present invention to provide a fast and highly accurate infeed conveyor which will feed a log or cant to a saw along a path approximating its radius of sweep curvature.

It is another object to provide a sawing system whichhas in combination an accurate conveyor that transports a log or cant along an adjustable curved path into a saw which is skewable relative to the conveyor to prevent binding in the cut.

It is a further object to infeed conveyor and saw combination in which the conveyor has the capability of being adjusted to varying degrees of curvature and the saw can be skewed to maintain a tangent relationship with a projection of the end of the conveyor.

It is also an object to provide a saw in combination with an infeed conveyor whose curvature can be varied to enable a sweepy cant to be sawed around the sweep curve in order to increase lumber recovery and yield.

It is yet another object to provide a variable curve infeed conveyor and saw combination which can be installed within the same space occupied by more conventional equipment.

It is still a further object to provide a variable curve infeed conveyor which can be translated toward or away from the saw or lower chipper head to control offset.

These and many other objects will become readily apparent to those skilled in the art upon reading the following detailed description taken in conjunction with the drawings.

DESCRIPTION OF THE PREFERRED EMBODIMENTS

Figure 1:
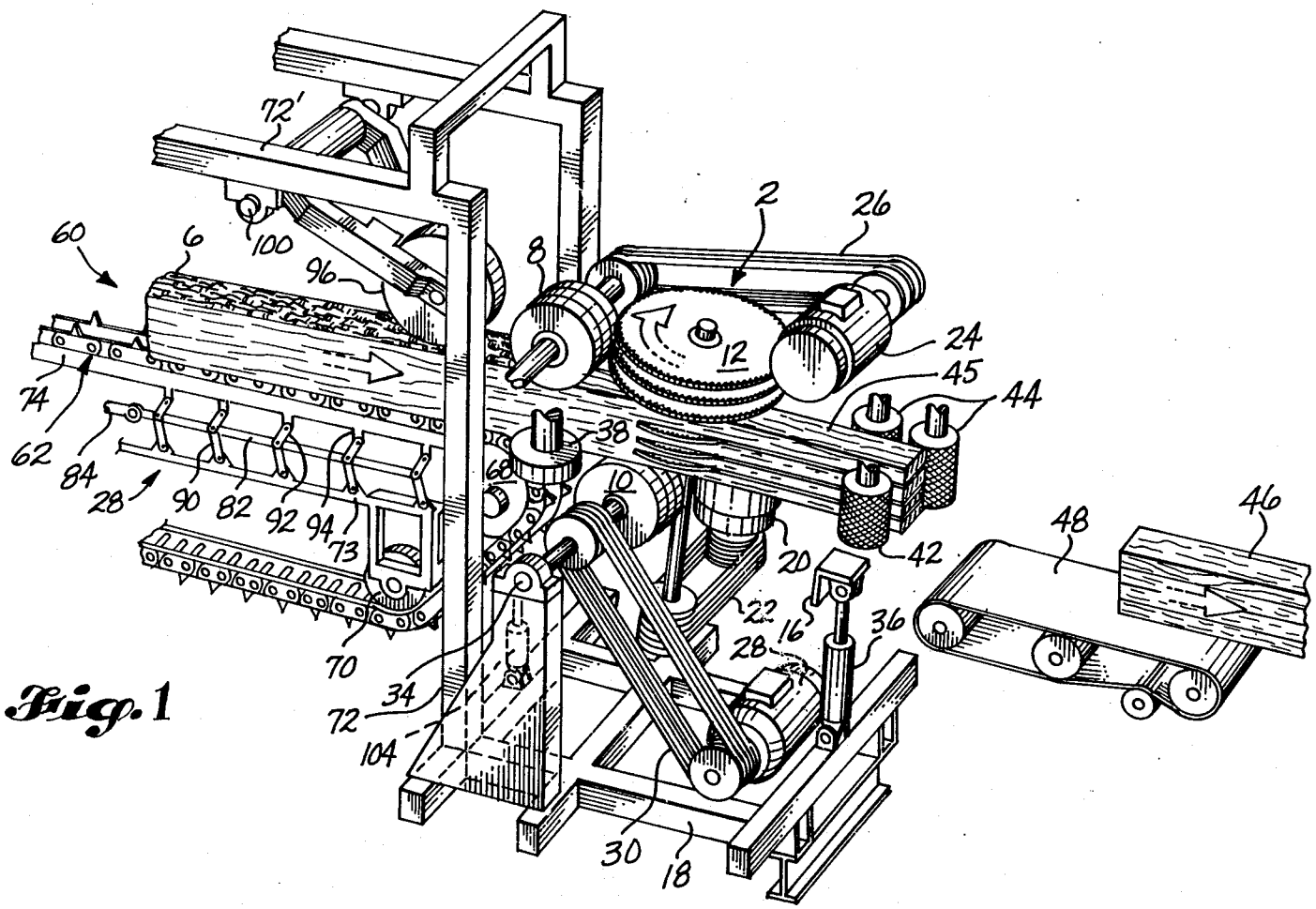
FIG. 1 is a perspective view of a vertical arbor gang saw using the infeed conveyor system of the present invention.
Figure 2:
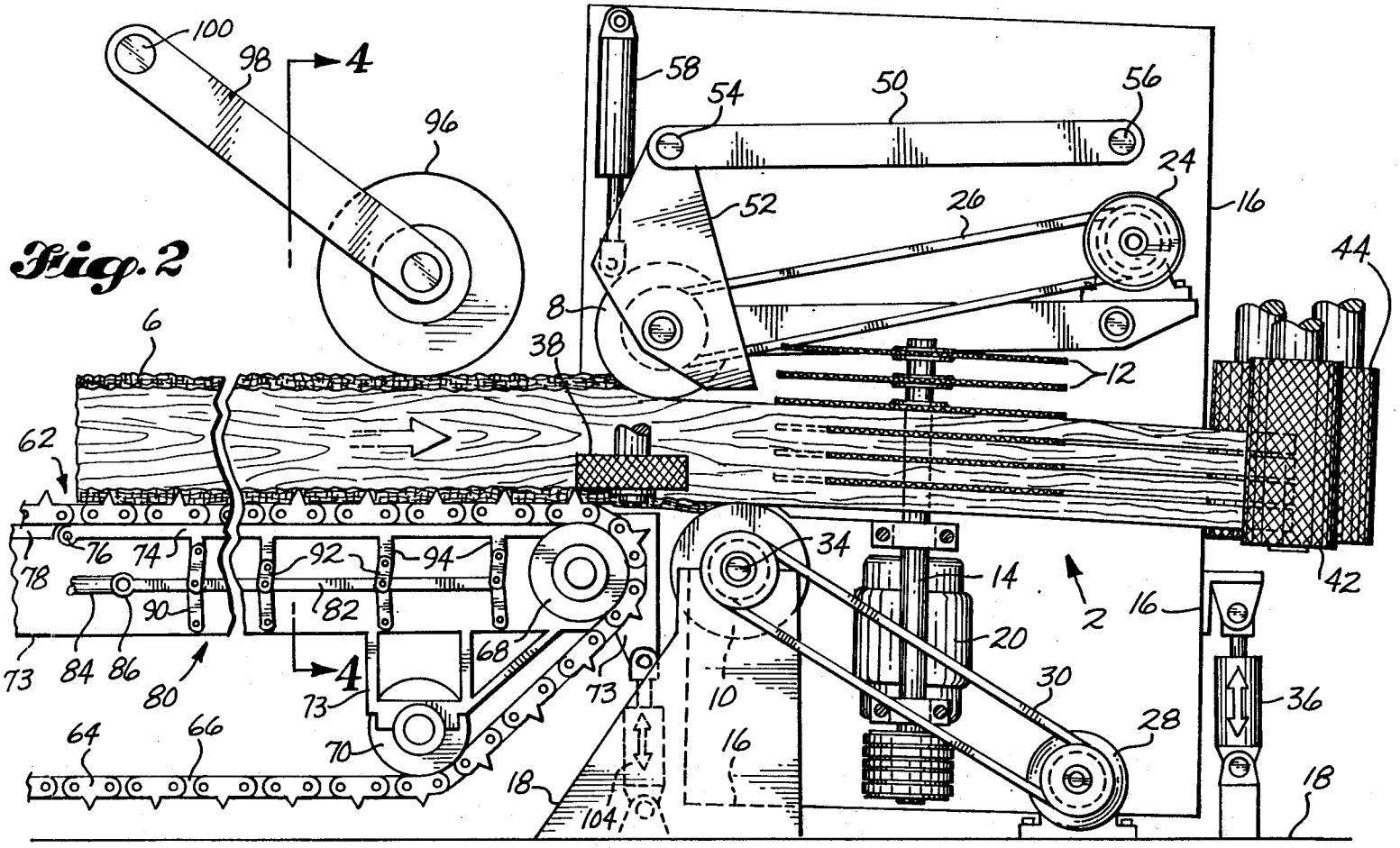
FIG. 2 is a side elevation of a gang saw and the discharge end of the infeed conveyor system.

The present invention can be best understood by referring now to th drawings. Throughout the drawings like numbers refer to like elements. In FIGS. 1 and 2 a vertical arbor circular saw gang saw 2 is situated adjacent a variable arc infeed conveyor 60. A cant 6, with side boards removed, is moving fromt he conveyor into the saw. Before entering the saw the upper surface of cant 6 is dressed by an upper chipper head 8 and the lower surface is similarly dressed by a lower chipper head 10. The gang saw has a number of parallel circular saws 12 mounted on a saw arbor/drive shaft 14. The gang saw mechanism is a mounted in a subframe or fourth frame 16 which in turn is tiltably mounted in a fixed position gang saw main frame or third frame 18. The saws are driven by a motor 20 through V-belts 22. Similarly, there is a drive motor 24 for the upper chipper head 8, acting through V-belts 26 and a drive motor 28 for the lower chipper had 10, coupled through V-belts 30. The lower chipper head has an axis of rotation 34 which also serves as the pivot point for subframe 16 carrying the gang saw assembly. A tilting or skewing cylinder 36 acts between subframe 16 and main frame 18 to control entry angle of the cant or log into the saws.

The chipper/gang saw portion of the assembly further contains guide rolls 38 which act against the sides of the incoming cant to provide stability. Similarly, side rolls 42, 44 provide stabilityto the sawn portion 45 as it leaves the gang saw. Th fully sawn cant 46 is picked up by conveyor 48 where it is removed to another location.

As is seen best in FIG. 2, the upper chipper head 8 is suspended on support arms, 50, 52 which are pivotally connected together at 54. In turn, support arm 50 is pivotally connected to subframe 16 as shown at 56. A control cylinder 58 adjusts the position of upper chipper head 8. Alternatively, upper chipper head 8 could be suspended from fixed second frame 72 rather than subframe 16. This may be a preferred construction since it eliminates movements introduced by skewing subframe 16.

The variable arc infeed conveyor system 60 has an endless sharp chain, generally indicated at 62. This has alternating pointed links 64 and sprocket engaging links 66 (FIG. 2). Each of the pointed links 64 has a pair of upstanding prongs to firmly engage the lower surface of the advancing cant.

The discharge end of the sharp chain has an upper head sprocket 68, which in this case is the driven sprocket, and a lower idler sprocket 70.

Figure 3:
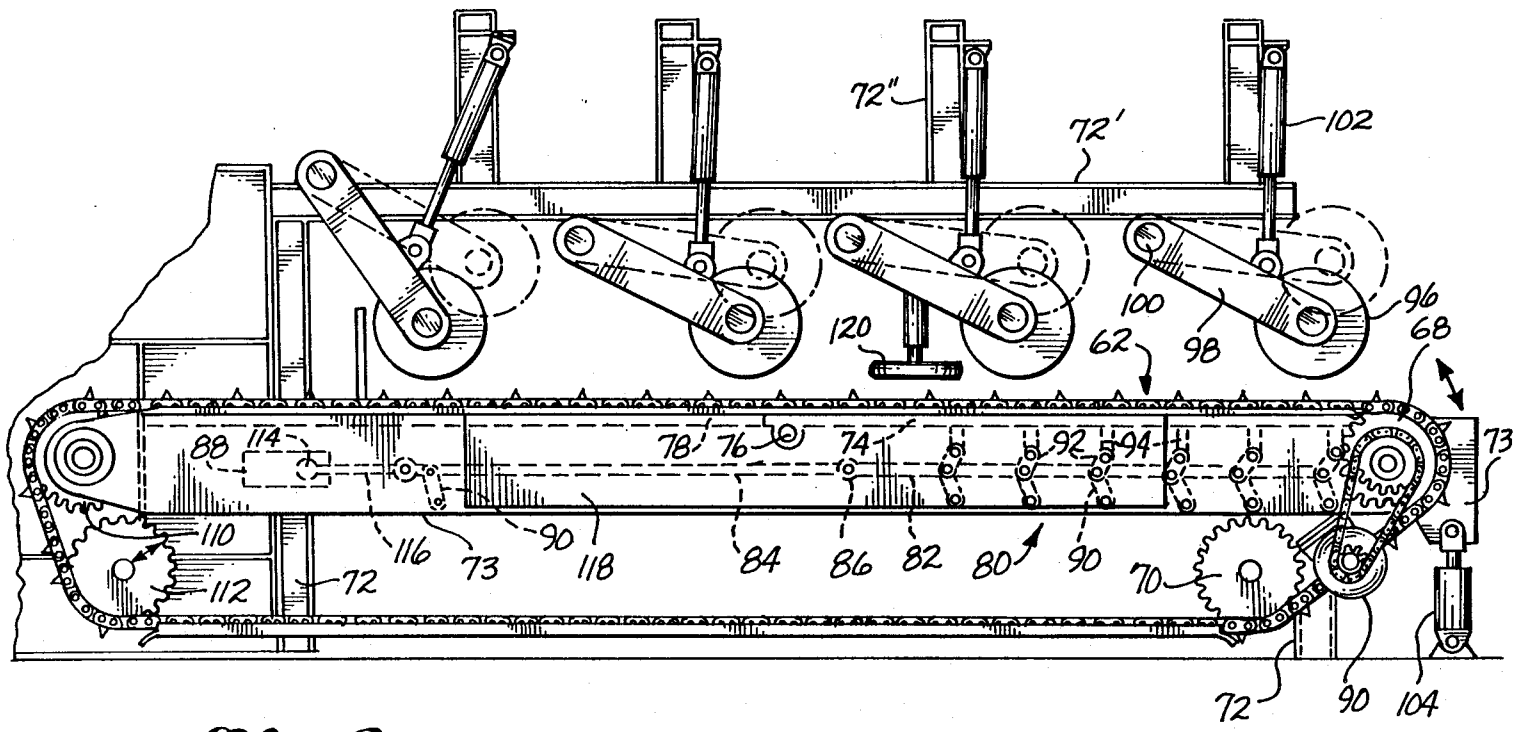
FIG. 3 is a side elevation view of the around-the-curve infeed system.

In similar manner, as is shown in FIG. 3, the receiving end of the sharp chain is carried by tail sprocket 110 and idler sprocket 112. In similar fashion to the saw, the conveyor is mounted in a fixed or second frame 72 which carries a pivotable subframe or first frame 73. The function of these two frame units will be shortly explained. Underlying about half of the sharp chain, from approximately the center to the discharge end, is a variable arc chain bed plate or slide bar 74. This may be made of metal or other conventional materials, but ultra high molecular weight polyethylene has been found to be particularly suitable. The inboard end fo slide bar 74 is pivotally attached to subframe 73 at a pivot point 76. The cant receiving end of the sharp chain is underlaid in similar fashion by a fixed slide bar 78.

The configuration of variable slide bar 74 is determined by an arc control mechanism, generally shown at 80. This consists of a longitudinal control shaft or push rod 82, 84, pivotally connected together at 86 and extending from an arc control cylinder 88 (FIG. 3). A series of lower stabilizing links 90, which are all the same length, depend from control or push shaft assembly 82, 84 and are pivotally connected both to the control shaft and to a portion of subframe 73. Similarly, a series of upper control links 92 of variable length are pivotally attached between push rod 82 and stubs 94, also of variable length, which depend from slide bar 74. It is evident that lateral adjustment of the push rod system will control the curvature of slide bar 74. Sharp chain 62 will precisely track along the surface of slide bar 74 whether it is in straight line or curved configuration.

The incoming cant is further stabilized by overhead pressure rolls 96 whose axles are journaled in support arms 98. These in turn are pivotally connected at bearings 100 attached to an upper portion 72' of the fixed second frame.

As is seen in FIG. 3, control or loading cylinders 102, depending from frame extensions 72", can be employed to exert a downward pressure on the stabilizing rolls.

Reference should now be made to FIG. 3. The purpose for constructing the infeed conveyor on a separate subframe 73 will now be explained. Subframe 73 is pivotally mounted to a fixed or second conveyor frame 72 along the axis of rotation of tail sprocket 110. The opposite or log discharge end of subframe 73 is united with the fixed second frame portion 72 through a position control cylinder 104. This can raise or lower the dischrage end of the infeed conveyor to adjust offset between the bottom surface of the cant and the first or 'zero' saw or lower chipper head. With this mechanism, the discharge end of the conveyor swings in a short arc centered on the axis of rotation of tail sprocket 110. Vertical movement here normally is limited to only a fiew centimetres.

As slide bar 74 is changed from a straight to a curved configuration, chain 62 must travel a slightly longer path. This variation in the required chain path can be readily accommodated by any of a number of well known means. For example, idler sprocket 112 can be spring loaded so that it can move radially a short distance to accommodate for variation in length of travel path.

Arc control cylinder 88 is preferably mounted in subframe 73 on trunions 114. The piston rod 116 of cylinder 88 may by connected either directly or through a pivotal link to the extension 84 of push rod 82.

In operation the new infeed conveyor and saw system will normally be used with a primary breakdown device which may include such well known devices as a quad or twin bandmill or circular saws, or a Chip-N-Saw canter. Chip-N-Saw canters are a product and registered trademark of the Canadian Car Division of Hawker Siddeley Canada Limited, Vancouver, B.C. A typical Chip-N-Saw installation will have four chipper heads to prepare opposed flat faces on a cant and ready it for further processing in a quad or twin saw and gang saw. If the log is sufficiently large, the quad or twin saw may take from one to four side boards off the faced log and leave a central gang cant of predetermined thickness. Typically the sweepy portion of the log will be removed as chips and is not considered to be recoverable as lumber. With the new infeed conveyor, two chipper heads would be used along the sides of the log to prepare a cant for the quad saws. The incoming log would normally be processed with the "horns down" so that the outgoing cant from the Chip-N-Saw canter would retain the sweep. As before, if the log was sufficiently large, several side boards might be removed. The sweep would be retained in the side boards and would normally be removed as waste in an edgere. However, the resulting gang cant would be sawn around the curve of the sweep so that the sweepy portion would be recovered as usable lumber. While the resulting boards would have a certain amount of bow while green, this normally flattens out during later processing. Thus, the process could be outlined as a series of steps as follows: (1) the diameter of the incoming log is sensed by appropriate scanners; (2) the sides of the log are faced off with the sweepy portion oriented down; (3) if the log was sufficiently large, an appropriate number of side boards would be removed in a quad or similar saw; (4) the remaining cant is scanned for sweep and for top-to-bottom thickness; (5) the upper and lower faces of the cant from the Chip-N-Saw are chipped to produce a gang cant of desired top-to-bottom dimension; (6) the resulting gang cant is sawn around the sweep curve to produce semifinished lumber.

Figure 4:
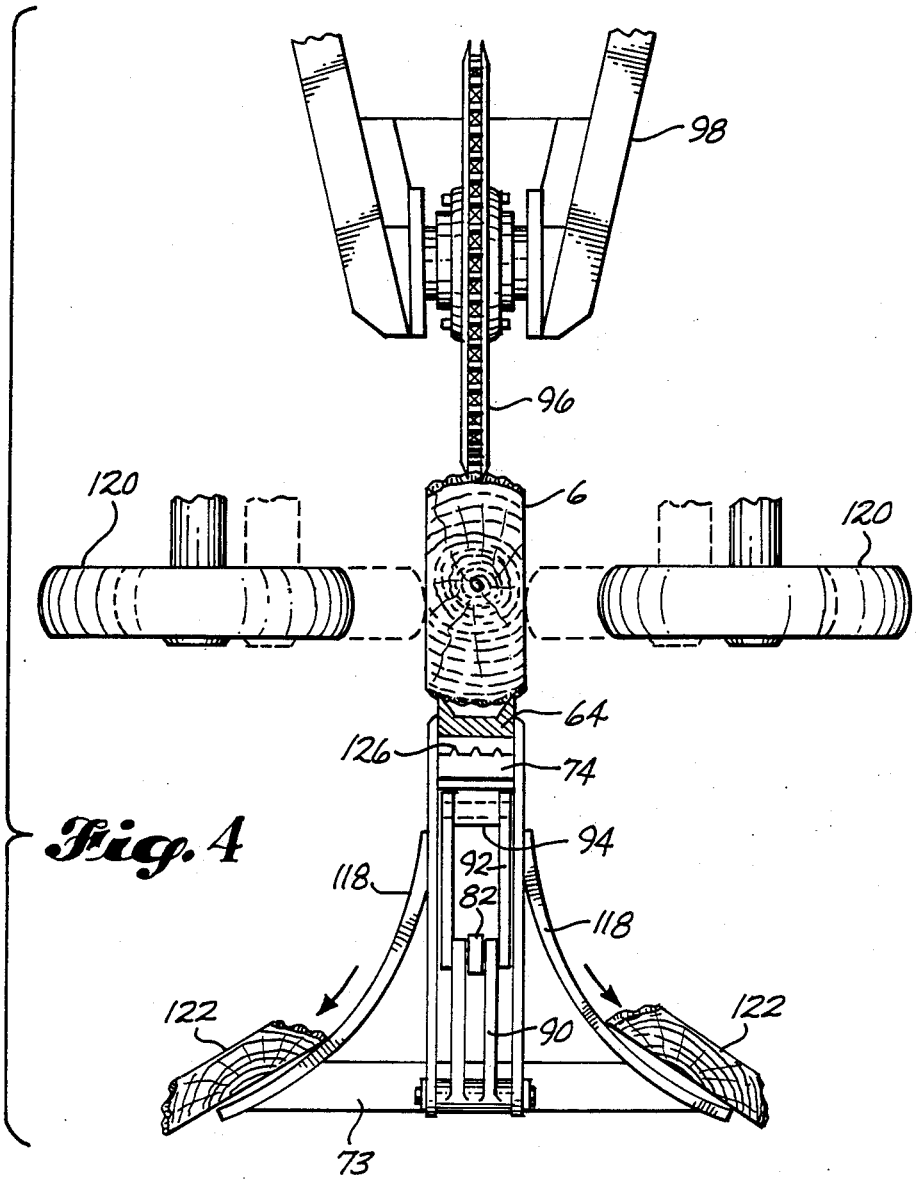
FIG. 4 is a sectional elevation taken through line 4—4 of FIG. 2.

FIG. 4 is a section taken along line 4—4 of FIG. 2. Here it shows a pair of side boards 122 which have just fallen away alon side board slides 118 following the quad saw and immediately prior to the passage of the cant through top and bottom chippers 8 and 10, respectively. Side pressure rolls 120 provide additional stabilization. As shown in the drawing, these are laterally retractable to permit the side boards to drop.

It will be noted in FIG. 4 that the pointed and sprocket engaging links 64 and 66, respectively, of the sharp chain have a grooved bottom surface 126. These grooves engage similar ridges on the upper surface of slide bar 74 and are an effective means of ensuring against any side-to-side weaving of sharp chain 62.

Having thus described the best mode known to the inventors of making and practicing their invention, it will be evident to those skilled in the art that many changes can be made in construction and operation without departing from the spirit of the invention. Thus, the invention is to be considered as limited only by the following claims.

We claim:

1. An infeed conveyor for a saw for optimally feeding cants or logs having varying amounts of sweep from piece to piece which comprises:

an endless sharp chain for conveying the cants;

means to drive the sharp chain, said means including a tail sprocket at the cant receiving end and a head sprocket at the cant discharging end;

a flexible slide bar for supporting at least that portion of the sharp chain adjacent the head sprocket;

first frame means for mounting and supporting the drive means and slide bar; and bending means for conforming the slide bar between a straight line and a curve which approximates an arc of a circle so that said sharp chain path thereby follows the slide bar configuration, whereby the conveyor can be configured into an arc which approximates the sweep curvature of a cant and a cant being conveyed can be guided into a saw along a path approximating its radius of curvature.

2. The conveyor of claim 1 in which the sharp chain has an upper cant transporting run and a lower return run, said slide bar supporting at least about that half of the upper run of the chain which includes the cant discharging end.

3. The conveyor of claim 2 which further includes an additional fixed straight line slide bar supporting the portion of the sharp chain that includes the cant receiving end.

4. The conveyor of claim 1 in which the flexible slide bar has an infeed end pivotally attached to the first frame means and an outfeed end not directly connectd to the frame means, the bending means being a series of actuating linkages of varying length pivotally connectd between a longitudinal push rod and the slide bar, said linkages acting to control the slide bar curvature in response to the push rod position.

5. The conveyor of claim 4 further including a second series of stabilizing linkages all of essentially identical length pivotally connected between the push rod and frame.

6. The conveyor of claim 4 in which the push rod position is controlled by a fluid activated cylinder acting between the first frame means and push rod.

7. The conveyor of claim 5 in which the push rod position is controlled by a fluid actuated cylinder acting between the first frame means and push rod.

8. The conveyor of claims 1, 2, 3, 4, 5, 6 or 7 which further includes a fixed position second frame means in which the first frame means and conveyor assembly are pivotally mounted about the axis of rotation of the tail sprocket, said conveyor further including offset adjustment means located adjacent the cant discharge end of the sharp chain, said adjustment means acting between the first and second frame means to raise or lower said discharge end.

9. In combination, a saw and an infeed conveyor for the saw for optimally feeding cants or logs having varying amounts of sweep from piece to piece which comprises:

an endless sharp chain for conveying the cants to the saw;

means to drive the sharp chain, said means including a tail sprocket at the cant receiving end and a head sprocket at the cant discharging end;

a flexible slide bar for supporting at least that portion of the sharp chain adjacent the head sprocket;

first frame means for mounting and supporting the drive means and slide bar;

bending means for conforming the slide bar between a straight line and a line which approximates an arc of a circle so that said sharp chain path thereby follows the slide bar configuration;

fixed position third frame means for supporting a saw assembly, said assembly including at least one saw mounted on an arbor;

pivotable fourth frame means mounted on said third frame means, said foruth frame means including at least one generally horizontal circular saw; and tilting means for the fourth frame means to skew the saw assembly so that the projected continuation of the discharge portion curvature of the conveyor is essentially tangent to a plane parallel to the plane of the saw at a point on the projection of the axis of the saw arbor thereby controlling the entry angle of the cant into the saw to prevent binding, said conveyor being configurable into an arc which approximates the sweep curvature of a cant so as to guide the cant into the saw along a path approximating its radius of curvature.

10. The combination of saw and conveyor of claim 9 in which the saw is a gangsaw comprising at least two parallel spaced apart circular saws.

11. The combination of saw and conveyor of claim 9 which further includes at least one transversely positioned chipper head located between the discharge end of the conveyor and the saw.

12. The combination of saw and conveyor of claim 11 in which a chipper head is located below the incoming cant to dress the lower surface thereof prior to sawing the cant.

13. The combination of saw and conveyor of claim 12 which further includes a second chipper head located above the incoming cant to dress the upper surface thereof prior to sawing the cant.

14. The combination of saw and conveyor of claim 12 in which the lower chipper head has a transverse axis which acts as the pivot point for the fourth frame means.

15. The combination of saw and coveyor of claims 9, 10, 11, 12, 13 or 14 which further includes fixed position second frame means in which the first frame means and conveyor assembly are pivotally mounted about the axis of rotation of the tail sprocket, said conveyor further including offset adjustment means located adjacent the cant discharge end of the sharp chain, said adjustment means acting between the first and second frame means to raise or lower said discharge end and control the offset between the bottom of an incoming cant and the cut line of the saw.

* * * * *

UNITED STATES PATENT AND TRADEMARK OFFICE

CERTIFICATE OF CORRECTION

PATENT NO. : 4,881,584

DATED : Nov. 21, 1989

INVENTOR(S) : Frank Wislocker, Charles Blickenderfer

It is certified that error appears in the above-identified patent and that said Letters Patent is hereby corrected as shown below:

In column 2, line 34, "Kenyon have had limited commercial application although" should read --Kenyon shows a somewhat similar system. --;

In column 2, line 36, "ton ne" should read --to one--;

In column 4, line 30, "arcuatelyr elative" should read --arcuately relative--;

In column 4, line 67, "whichhas" should read --which has--;

In column 5, line 3, "to infeed" should read --to provide an infeed--;

In column 5, line 55, "chipper had 10" should read --chipper head 10--;

In column 6, line 66, "dischrage" should read --discharge--;

In column 7, line 4, "fiew" should read --few--.

Signed and Sealed this

Eighteenth Day of December, 1990

*Attest:*

*Attesting Officer*

HARRY F. MANBECK, JR.

*Commissioner of Patents and Trademarks*